US008393705B2

(12) United States Patent
Shigeno et al.

(10) Patent No.: US 8,393,705 B2
(45) Date of Patent: Mar. 12, 2013

(54) RECORDING APPARATUS WITH A LINE RECORDING HEAD

(75) Inventors: Kenji Shigeno, Yokohama (JP); Yasuhiko Ikeda, Sagamihara (JP); Masahito Yoshida, Shiki (JP); Koichiro Kawaguchi, Yokohama (JP); Toshiki Takeuchi, Yokohama (JP); Masato Izumi, Kawasaki (JP); Ryosuke Sato, Kawasaki (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 183 days.

(21) Appl. No.: 12/950,594

(22) Filed: Nov. 19, 2010

(65) Prior Publication Data

US 2011/0122189 A1 May 26, 2011

(30) Foreign Application Priority Data

Nov. 20, 2009 (JP) ..... 2009-265231

(51) Int. Cl.
*B41J 29/38* (2006.01)

(52) U.S. Cl. ..... 347/16

(58) Field of Classification Search ..... 347/86, 347/8, 16, 98, 42; 101/485; 399/395; 271/228, 271/10.03
See application file for complete search history.

(56) References Cited

U.S. PATENT DOCUMENTS

| | | | | |
|---|---|---|---|---|
| 6,647,884 | B1 * | 11/2003 | La Vos et al. | 101/485 |
| 6,655,797 | B2 * | 12/2003 | Smith et al. | 347/98 |
| 7,004,562 | B2 * | 2/2006 | Madeley | 347/42 |
| 7,984,958 | B2 * | 7/2011 | Koga et al. | 347/16 |
| 2005/0151772 | A1 | 7/2005 | Oishi | |
| 2006/0250460 | A1 * | 11/2006 | Silverbrook | 347/86 |
| 2008/0056790 | A1 * | 3/2008 | Maruyama | 399/395 |
| 2009/0002412 | A1 * | 1/2009 | Kawakami et al. | 347/8 |
| 2010/0013149 | A1 * | 1/2010 | Kondo | 271/228 |

FOREIGN PATENT DOCUMENTS

| | | | |
|---|---|---|---|
| JP | 9329885 | * | 12/1997 |
| JP | 2005-169962 | A | 6/2005 |

* cited by examiner

*Primary Examiner* — Stephen Meier
*Assistant Examiner* — Carlos A Martinez
(74) *Attorney, Agent, or Firm* — Canon USA Inc. IP Division

(57) ABSTRACT

An apparatus includes a line-type recording head including a plurality of recording elements formed thereon, a holding unit configured to hold a sheet, a conveyance mechanism configured to convey the sheet held by the holding unit to a position of recording by the recording head, a shift mechanism capable of relatively shifting a position of the sheet in a sheet width direction with respect to the recording head while the sheet is fed from the holding unit to the recording position, and a control unit configured to control the conveyance mechanism and the shift mechanism.

21 Claims, 15 Drawing Sheets

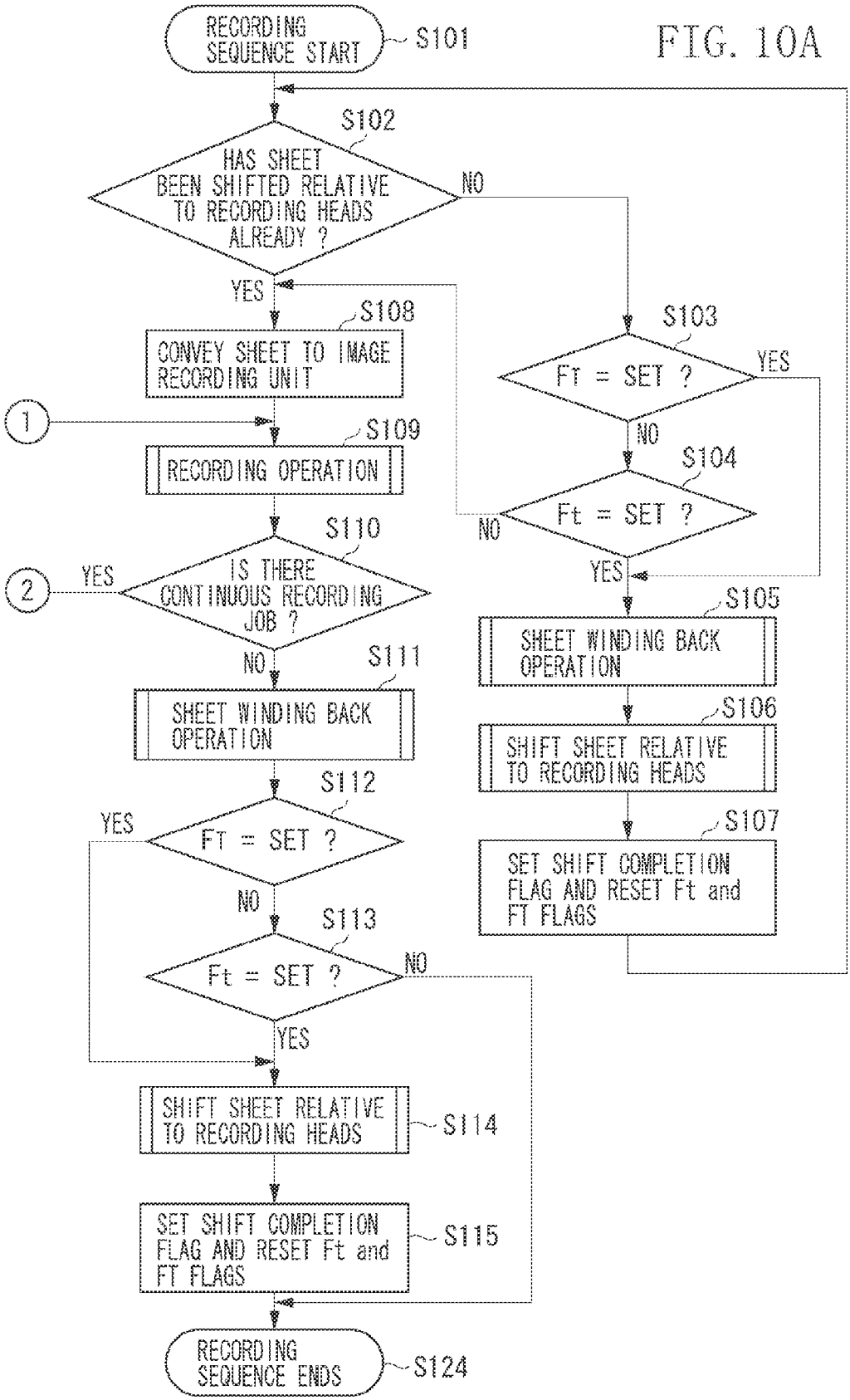
FIG. 10A
RECORDING SEQUENCE START
S101
S102
HAS SHEET BEEN SHIFTED RELATIVE TO RECORDING HEADS ALREADY ?
NO
YES
S108
CONVEY SHEET TO IMAGE RECORDING UNIT
1
S109
RECORDING OPERATION
S110
IS THERE CONTINUOUS RECORDING JOB ?
2
YES
NO
S111
SHEET WINDING BACK OPERATION
S112
FT = SET ?
YES
NO
S113
Ft = SET ?
NO
YES
SHIFT SHEET RELATIVE TO RECORDING HEADS
S114
SET SHIFT COMPLETION FLAG AND RESET Ft and FT FLAGS
S115
RECORDING SEQUENCE ENDS
S124
S103
FT = SET ?
YES
NO
S104
Ft = SET ?
NO
YES
S105
SHEET WINDING BACK OPERATION
S106
SHIFT SHEET RELATIVE TO RECORDING HEADS
S107
SET SHIFT COMPLETION FLAG AND RESET Ft and FT FLAGS

RECORDING APPARATUS WITH A LINE RECORDING HEAD

BACKGROUND OF THE INVENTION

1. Field of the Invention

The present invention generally relates to recording and, more particularly, to a recording apparatus provided with a line recording head.

2. Description of the Related Art

A line printer provided with a full-line type line recording head can print a large amount of data at high speed, and is mainly used for print on demand. Usually, a line printer is adapted to handle various sheet widths. However, printing data on a large number of sheets having a narrow width results in that nozzles located at a position corresponding to the sheet width have prominently high discharge frequencies, compared to the other regions. The frequently used nozzles, in particular, core units of the recording head such as heaters and piezoelectric elements are rapidly deteriorated, and the ink discharge accuracy thereof is reduced. As a result, the image quality is partially deteriorated, which causes image unevenness.

Japanese Patent Application Laid-Open No. 2005-169962 discusses the technique for alleviating intensive use of a certain nozzle. The recording apparatus discussed in Japanese Patent Application Laid-Open No. 2005-169962 includes two feeding trays respectively corresponding to two recording positions disposed offset from each other in the sheet width direction of a sheet. According to this recording apparatus, the nozzle usage frequency is distributed by switching the feeding tray to be used to switch the recording position.

However, the apparatus discussed in Japanese Patent Application Laid-Open No. 2005-169962 has the following problems.

(1) The recording positions respectively corresponding to the two feeding trays are predetermined and cannot be changed. Therefore, although the usage frequency is reduced by half, the deterioration of the nozzles at the predetermined recording positions still progresses faster than the other regions.

(2) The two feeding trays can only supply sheets of a predetermined same size, and partial deterioration of nozzles can be alleviated only when sheets of that size are used. This recording apparatus lacks flexibility for handling various sheet sizes.

(3) Even if the recording apparatus is configured to enable replacement of feeding trays having different sizes for handling various sheet sizes, in this case, a pair of two feeding trays is necessary for each of various sizes, and storage of the feeding trays while out of use should be prepared, which may cause another problem. Further, in this case, the recording apparatus should have a tray holding mechanism and a conveyance mechanism which can be used with the feeding trays of the various sizes. As a result, the recording apparatus becomes bulky and a complicated control becomes necessary.

SUMMARY OF THE INVENTION

The present invention provides a recording apparatus capable of processing various sheets having different sheet widths and preventing a line recording head from being partially deteriorated. Further, the present invention provides a recording apparatus capable of processing various sheets having different sheet widths and preventing parts constituting a sheet conveyance system such as a roller and a guide from being abraded and deteriorated unevenly in the sheet width direction.

According to an aspect of the present invention, an apparatus includes a line-type recording head including a plurality of recording elements formed thereon, a holding unit configured to hold a sheet, a conveyance mechanism configured to convey the sheet held by the holding unit to a position of recording by the recording head, a shift mechanism capable of relatively shifting a position of the sheet in a sheet width direction with respect to the recording head while the sheet is fed from the holding unit to the recording position, and a control unit configured to control the conveyance mechanism and the shift mechanism.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 10A and 10B are flowcharts illustrating an operation sequence when an image is recorded according to an exemplary embodiment.

DESCRIPTION OF THE EMBODIMENTS

Various exemplary embodiments, features, and aspects of the invention will be described below with reference to the drawings.

Figure 1:
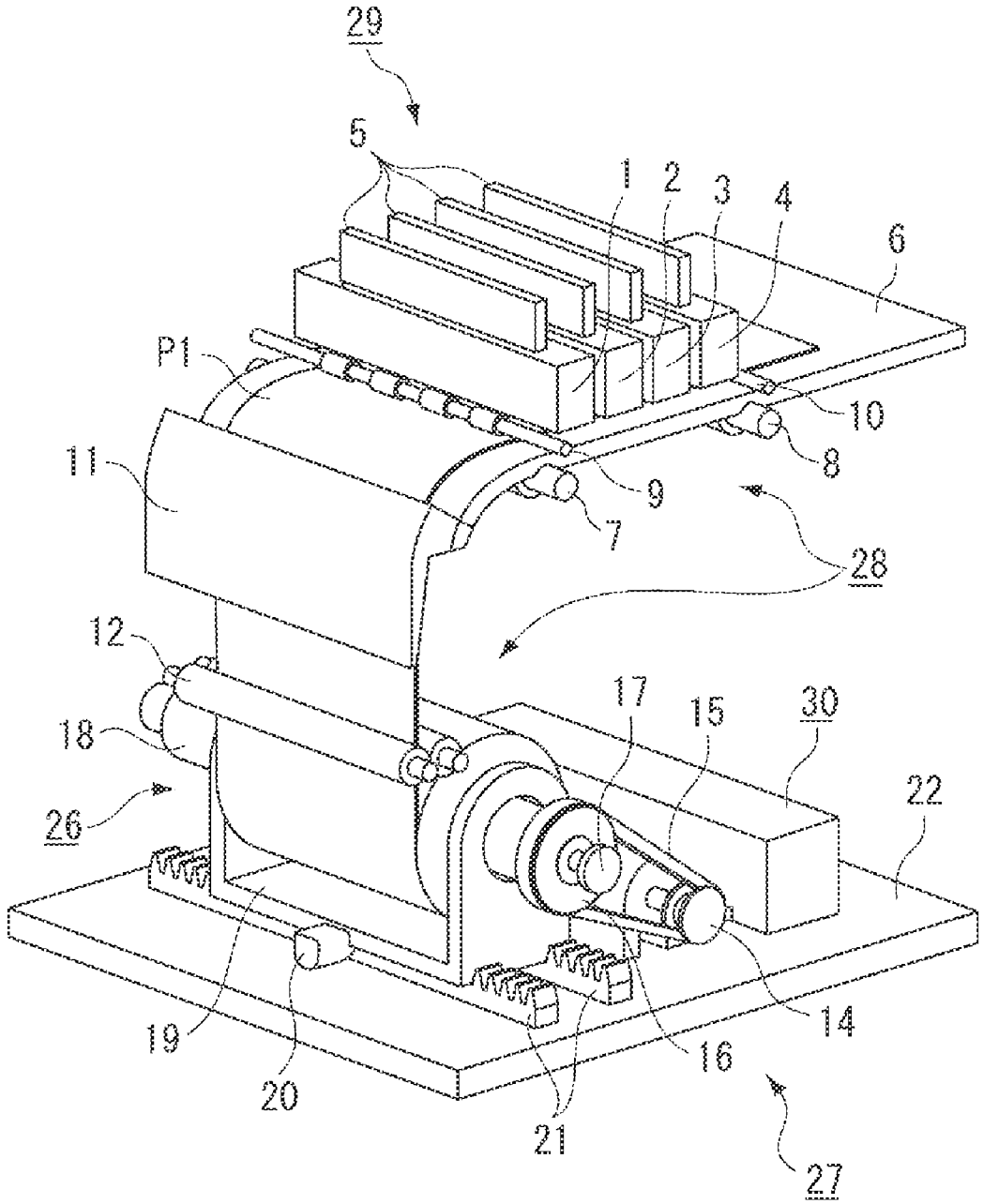
FIG. 1 is a perspective view illustrating main parts of a recording apparatus according to a first exemplary embodiment.
Figure 2:
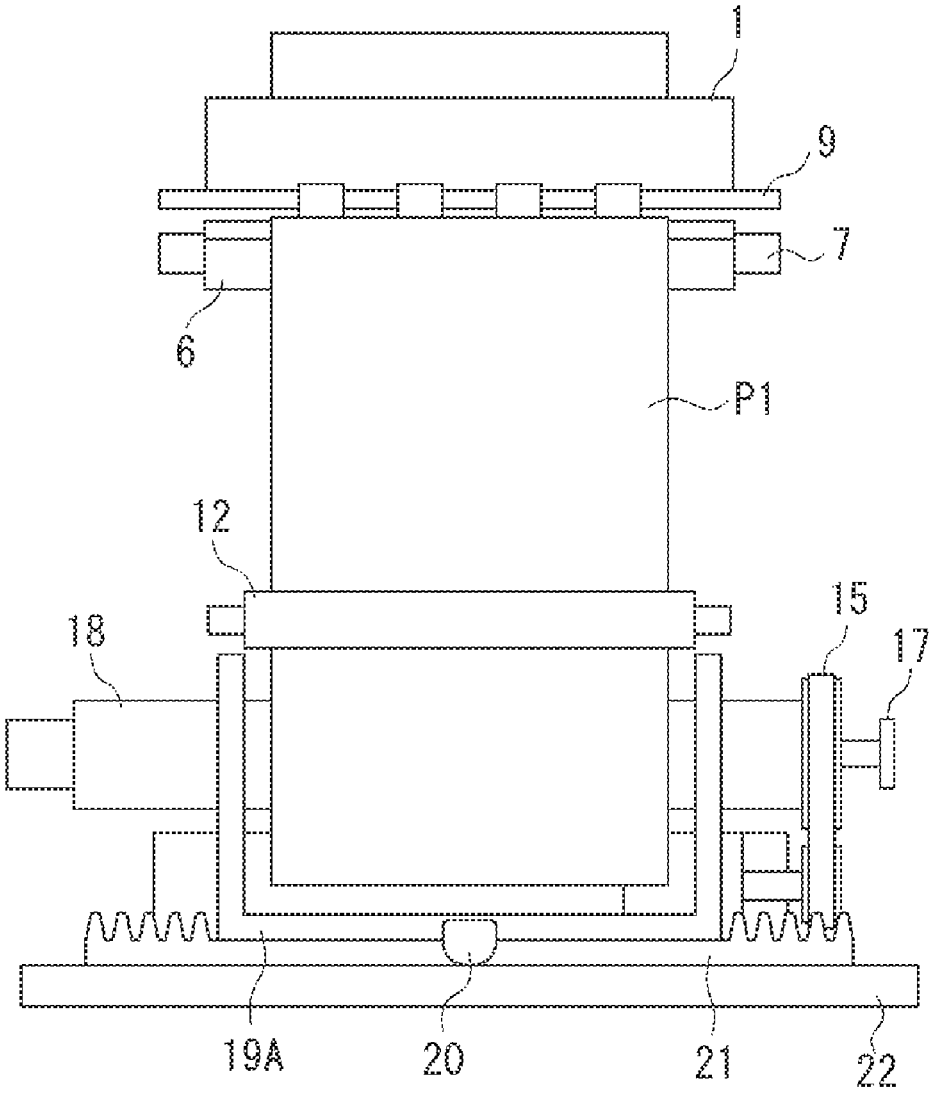
FIG. 2 is a front view of the recording apparatus in FIG. 1 using a sheet of a maximum size.
Figure 3:
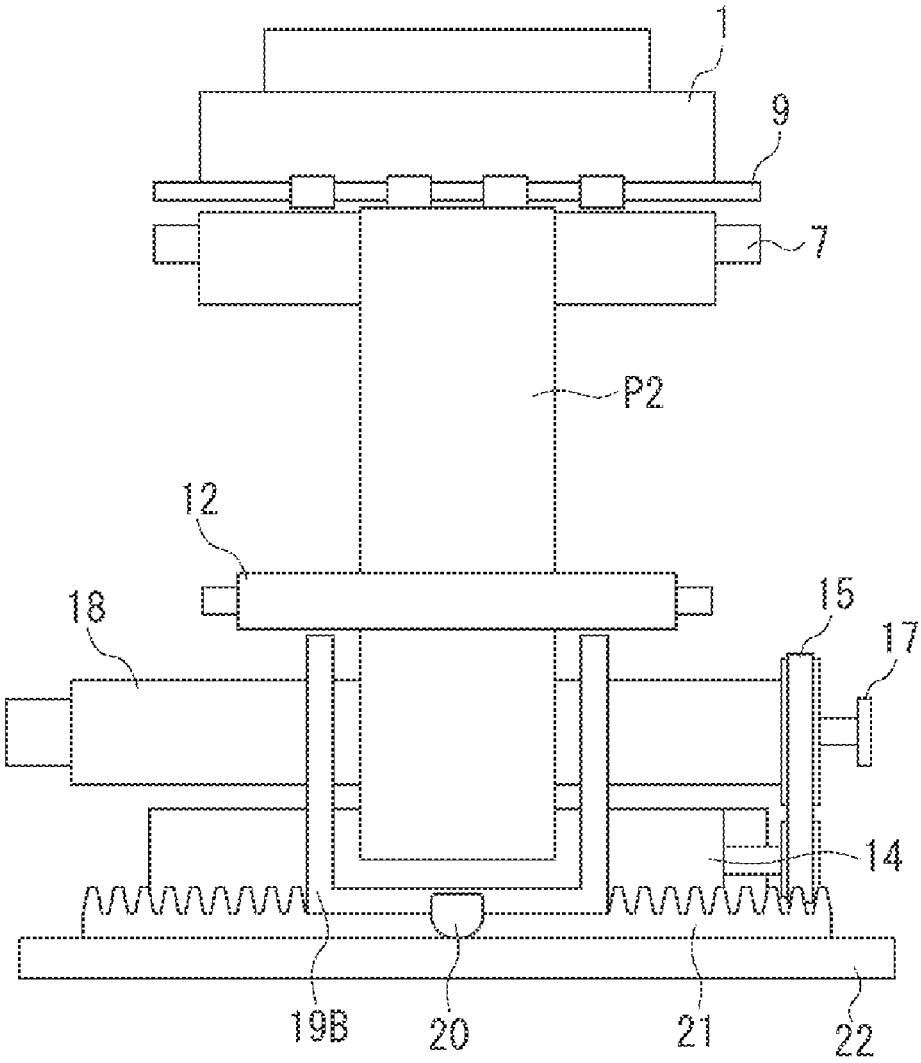
FIG. 3 is a front view of the recording apparatus in FIG. 1 using a sheet of a minimum size.

A first exemplary embodiment of the present invention will now be described. FIG. 1 is a perspective view illustrating main parts of a recording apparatus. FIG. 2 is a front view of the recording apparatus processing a sheet P1 having a maximum size, and FIG. 3 is a front view of the recording apparatus processing a sheet P2 having a minimum size.

Referring to FIG. 1, the recording apparatus generally includes a sheet holding unit 26, a shift mechanism 27, a sheet conveyance mechanism 28, an image recording unit 29, and a control unit 30. These units will be sequentially described below.

(Sheet Holding Unit)

The sheet P1 held by the holding unit 26 is a continuous sheet (hereinafter referred to as "sheet") wound into a roll. The sheet holding unit 26 includes a support shaft 18 inserted through a roll core of the sheet P1 and integrally assembled with the sheet P1, and a holder 19 rotatably holding the support shaft 18 at the both sides of the sheet P1. Further, the sheet holding unit 26 includes a drive mechanism constituted by a drive motor 14, a drive belt 15 for transmitting the drive force of the drive motor 14 to the support shaft 18, and a pulley 16. A sheet held by the drive mechanism is rotatable in the forward direction (the direction that sheet is sent forward) and in the reverse direction (the direction that sheet is winded back). An encoder 17 is provided to detect a rotational state (rotation amount and rotation angle) of the support shaft 18. The sheet holding unit 26 can selectively hold the sheet P1 having a maximum width size (refer to FIG. 2), the sheet P2 having a minimum width size (refer to FIG. 3), and a sheet having a width of any size between the maximum size and the minimum size. The holder 19 is selected according to a size (width) of a sheet to be used. A holder 19A, which has a width slightly greater than the width of the sheet P1, is used for the sheet P1 (refer to FIG. 2), while a holder 19B, which is narrower than the holder for use with the sheet P1, is used for the sheet P2 (refer to FIG. 3). For mounting a sheet onto the recording apparatus, a user removes the holder 19 and the support shaft 18 from the apparatus, inserts the support shaft 18 through a sheet of a desired size, mounts the sheet with the support shaft 18 onto an appropriate holder 19, and then sets them to the recording apparatus.

(Shift Mechanism)

The shift mechanism 27 is a mechanism supporting the sheet holding unit 26 on a support board 22 in such a manner that the sheet holding unit 26 can be shifted in a predetermined direction. Two guide rails 21 are disposed on the support board 22 along a predetermined direction (the sheet width direction of a sheet). The holder 19 is placed on the guide rails 21, and can be shifted along the guide rails 21 by means of a rack-and-pinion mechanism. The top surfaces of the guide rails 21 constitute rack gear surfaces, and pinion gears (not shown) are provided under the bottom surface of the holder 19. A drive motor 20 is provided as a drive source for rotating the pinion gears. The drive motor 20 is schematically illustrated in FIGS. 1 to 3, and may be embodied by any of a self-propelled motor, a gear transmission motor, and a belt transmission motor. The holder 19 can be moved to an arbitrary position in a nonstep and continuous manner by a rotation of the drive motor 20. The drive motor 14 of the sheet holding unit 26 is also integrally attached to the holder 19, and therefore is moved with the holder 19. In sum, the shift mechanism 27 shifts the whole sheet holding unit 26 relative to the support board 22 in the sheet width direction.

(Sheet Conveyance Mechanism)

The sheet conveyance mechanism 28 is a mechanism for conveying a sheet pulled out from a roll held by the sheet holding unit 26 to a position where data is recorded onto the sheet by recording heads which will be described later. The sheet conveyance mechanism 28 includes a plurality of pairs of rollers for conveying a sheet while holding it, and guide members disposed on front and back surface of a sheet for guiding a sheet in the conveyance path.

Feeding rollers 12, which are disposed on the most upstream side near the sheet holding unit 26, upwardly feed a sheet pulled out from a roll while holding it. The drive motor 14 also rotates in synchronization with rotations of the feeding rollers 12, thereby reducing a load of the feeding rollers 12. The sheet P1 fed by the feeding rollers 12 advances along the conveyance path defined by a conveyance guide 6 (lower guide) and an upper guide (not shown). A pair of rollers constituted by a main conveyance roller 7 and a driven roller 9 adapted to be driven to rotate by the roller 7, and further, a pair of rollers constituted by a sub conveyance roller 8 and a driven roller 10 adapted to be driven to rotate by the roller 8 are disposed at the downstream side of the conveyance path. When an image is recorded onto a sheet, the sheet is highly accurately conveyed due to the operations of the main conveyance roller 7 and the sub conveyance roller 8.

On the conveyance path, the feeding rollers 12, the main conveyance roller 7, the driven roller 9, the sub conveyance roller 8, and the driven roller 10, which constitute the sheet conveyance mechanism 28, are shaped and disposed so that each of them is substantially line-symmetrical with respect to the sheet width. Similarly, the conveyance guide 6 (lower guide) and the upper guide (not shown) are also shaped and disposed so that each of them is substantially line-symmetrical with respect to the sheet width. Due to this arrangement, it is possible to eliminate the unbalance of the conveyance resistance when a sheet is conveyed, and realize stabilized sheet conveyance.

(Image Recording Unit)

The image recording unit 29 includes four full-line type line recording heads (hereinafter referred to as "recording heads") 1 to 4 disposed in this order along the sheet conveying direction. The recording heads 1 to 4 each have a recording width extending in the range covering the sheet P1 of the maximum size possible to be used, and have a large number of ink discharge nozzles (hereinafter referred to as "nozzles") for discharging ink which are arranged along the sheet width direction intersecting with the sheet conveying direction (in the present exemplary embodiment, a direction perpendicular to the sheet conveying direction). The recording heads 1 to 4 each may be constituted by a continuous single nozzle chip, or divided nozzle chips regularly arranged, for example, in a line or in a staggered arrangement. The recording head 1 discharges black (K) ink, the recording head 2 discharges cyan (C) ink, the recording head 3 discharges magenta (M) ink, and the recording head 4 discharges yellow (Y) ink. The present exemplary embodiment uses four colors, but this is merely an example. The recording apparatus may use more than four colors or less than four colors. Recording heads of the number corresponding to the number of colors to be used are arranged along the sheet conveying direction. Ink is supplied to each recording head via a flexible supply tube from an ink tank (not shown).

In the present exemplary embodiment, the recording heads 1 to 4 are inkjet method heads employing an heating element method, a piezoelectric element method, an electrostatic element method, or a micro electro mechanical system (MEMS) element method. Furthermore, the present invention is not limited to the inkjet method, and can be applied to various printing methods using a large number of recording elements arranged in a line, such as a thermal printing method (for example, a dye sublimation method or a thermal transfer method) and a dot impact method. In the inkjet method, one nozzle corresponds to one recording element. In the thermal printing method, one heater corresponds to one recording element. In the dot impact method, one dot drive mechanism corresponds to one recording element.

The recording heads 1 to 4 are provided with respectively corresponding history memories 5 (nonvolatile memories), and store usage history information for each region, which is defined by grouping the recording elements of each recording head into a plurality of regions, or for each element. For example, the recording heads 1 to 4 store usage history information for each nozzle chip. Alternatively, instead of providing the history memory 5 to each of the recording heads 1 to 4, the usage history may be collectively stored in a nonvolatile memory of the control unit 30.

Figure 4:
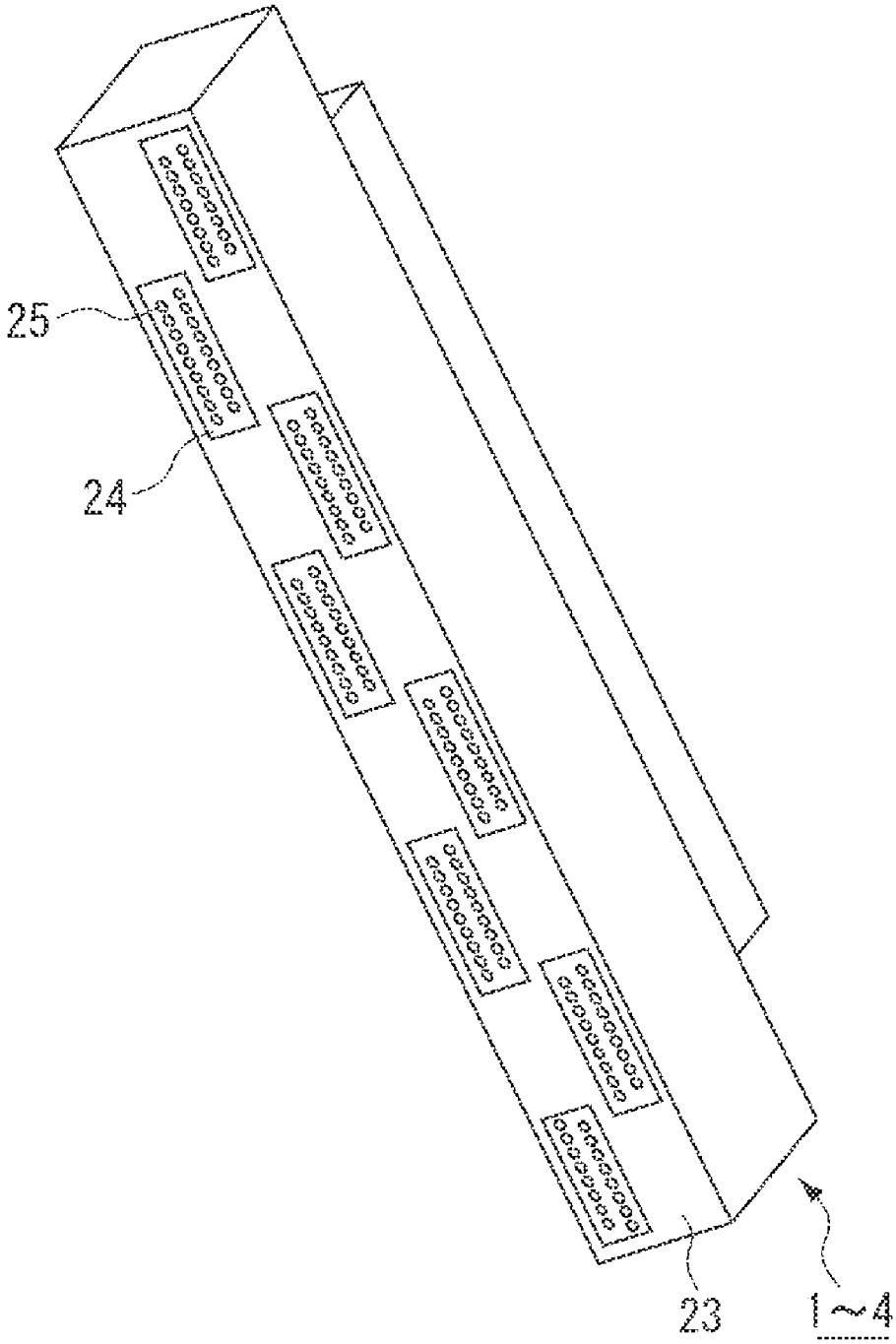
FIG. 4 schematically illustrates a nozzle array of a recording head according to an exemplary embodiment.

FIG. 4 schematically illustrates a nozzle array of the recording head. In the present exemplary embodiment, the recording head is what is called a full multi head, and a plurality of nozzle chips 24 are arranged in a staggered arrangement on a nozzle surface 23 of the recording head. Each nozzle chip 24 includes a predetermined number of nozzle groups 25 (for example, a predetermined number of nozzles arranged in two rows out of alignment with each other in the width direction by a half pitch), and constitutes one nozzle unit. The arrangement of the nozzle chips 24 is not limited to the staggered arrangement in which the nozzle chips 24 are arranged in a zigzag pattern. The nozzle chips 24 may be arranged in a line, or may be constituted by a continuous single nozzle chip.

(Control Unit)

Figure 5:
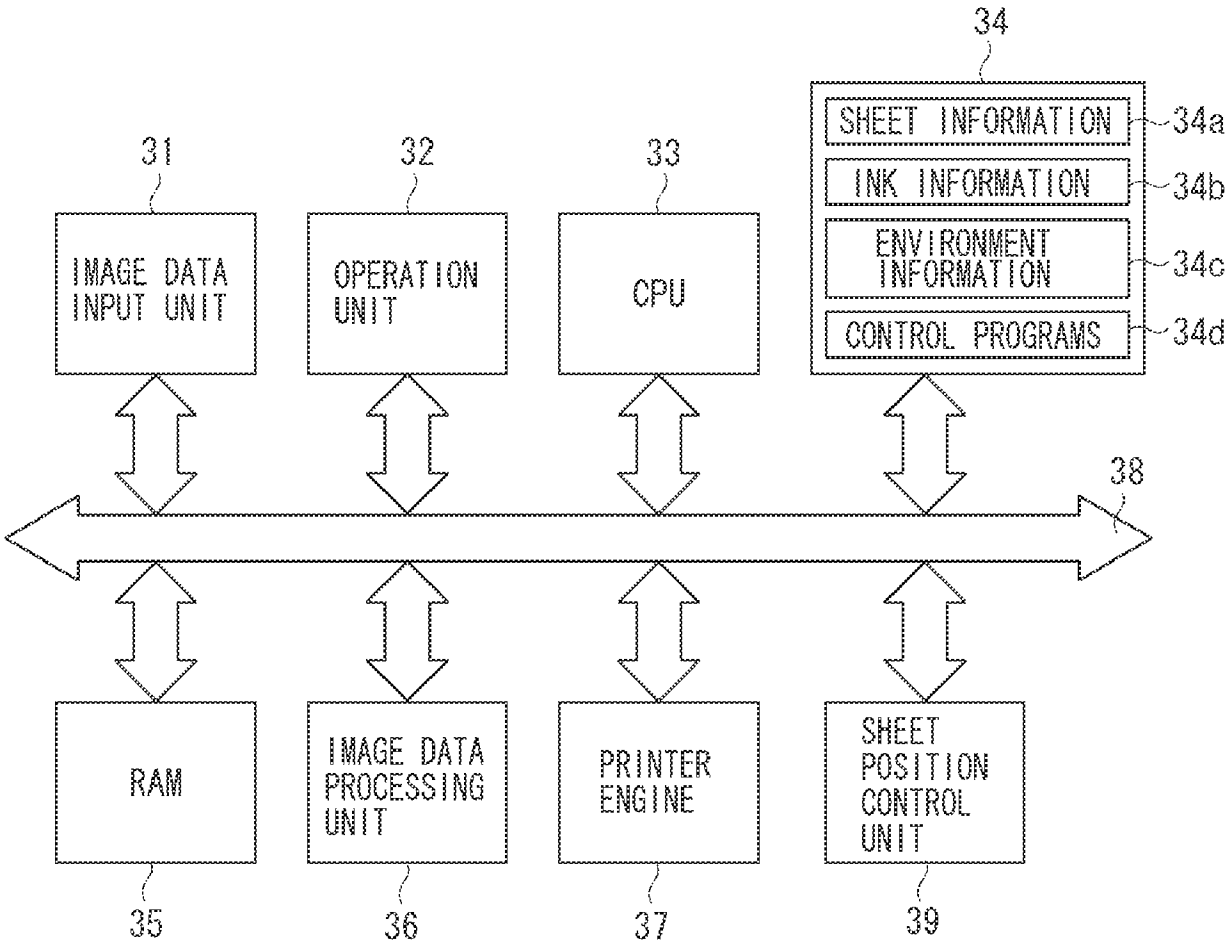
FIG. 5 is a block diagram of a control unit according to an exemplary embodiment.

The control unit 30, which is responsible for various controls of the recording apparatus, is disposed on the support board 22. FIG. 5 is a block diagram of the control unit 30. The control unit 30 includes an image data input unit 31, an operation unit 32, a central processing unit (CPU) 33, a writable nonvolatile memory 34, a random access memory (RAM) 35, an image data processing unit 36, a printer engine 37, and a bus 38. The nonvolatile memory 34 includes a block 34*a* storing sheet type information, a block 34*b* storing information related to ink, a block 34*c* storing information related to an environment, such as a temperature and humidity, at the time of recording, and a block 34*d* storing various control programs.

The image data input unit 31 inputs multivalued image data from an image input device such as a scanner or a digital camera, and multivalued image data stored in, for example, a personal computer. The operation unit 32 includes various keys through which a user sets various parameters related to a recording operation (for example, an image recording width, a sheet size, a sheet type, and a recorded image type), and instructs a recording start. The image data processing unit 36 performs the processing for creating an ink discharge pattern from input multivalued image data. The printer engine 37 controls ink discharge based on the discharge pattern created by the image data processing unit 36. A sheet position control unit 39 controls the relative position between the recording heads 1 to 4 and a sheet.

(Description of Recording Operation Sequence)

Sheets of various sizes can be used in the recording apparatus according to the present exemplary embodiment. However, the operation sequence varies depending on the sheet size. In case of use of the sheet P1 having the maximum size as illustrated in FIG. 2, recording is performed using almost whole areas of the nozzles of the recording heads 1 to 4 evenly, and therefore deterioration of the nozzles substantially evenly progresses. Further, the parts which a sheet contacts, such as the rollers and the guides constituting the sheet conveyance mechanism 28, are abraded evenly over the whole areas thereof in the sheet width direction, and therefor they are not partially deteriorated. On the other hand, in the case of heavy use of the sheet P2 having a narrow width as illustrated in FIG. 3, recording is performed using only a portion corresponding to the sheet width of the sheet P2 in the sheet width direction, and therefore deterioration of the nozzles and abrasion of the rollers and the guides unevenly progress. As a result, partial unevenness becomes noticeable on an obtained image.

Figure 6B:
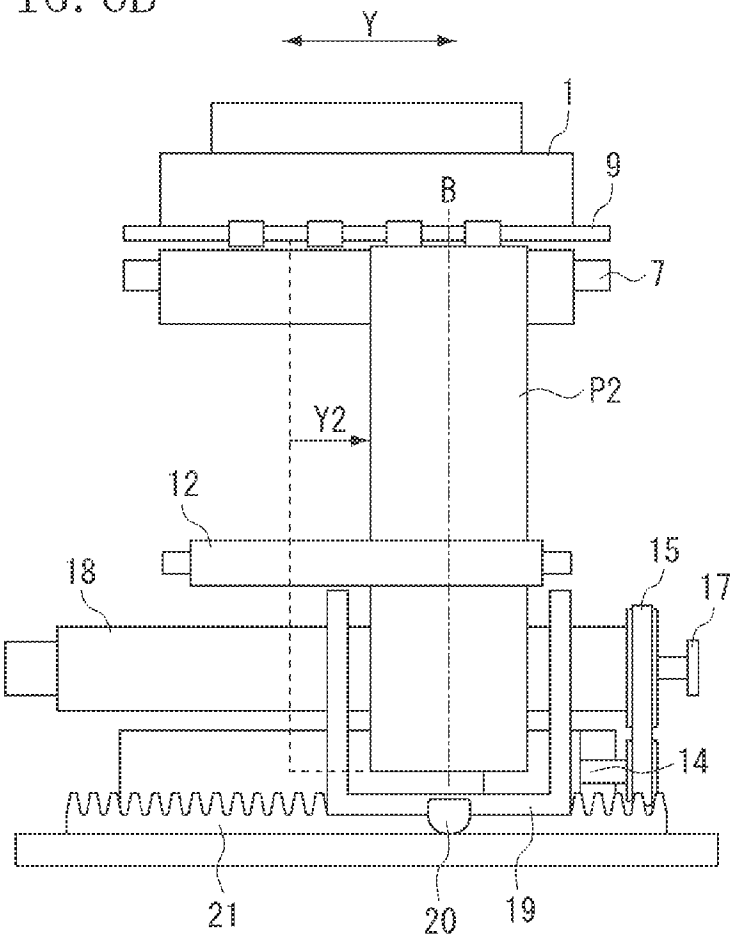
FIGS. 6A and 6B are front views illustrating a relative shift between a sheet and the recording head according to an exemplary embodiment.
Figure 6A:
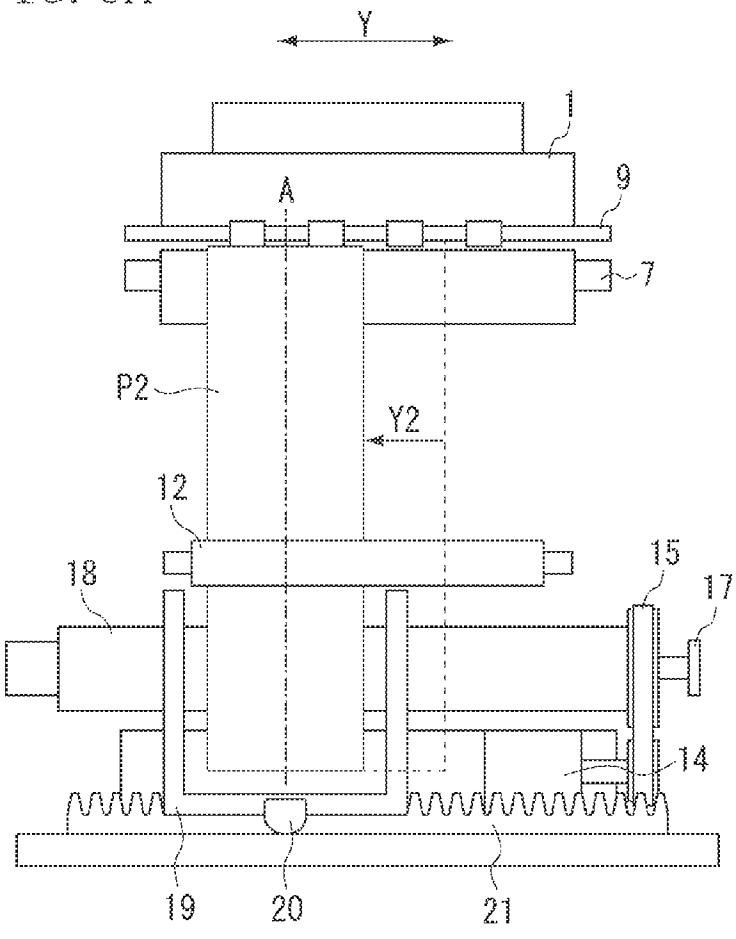
Figure 9:
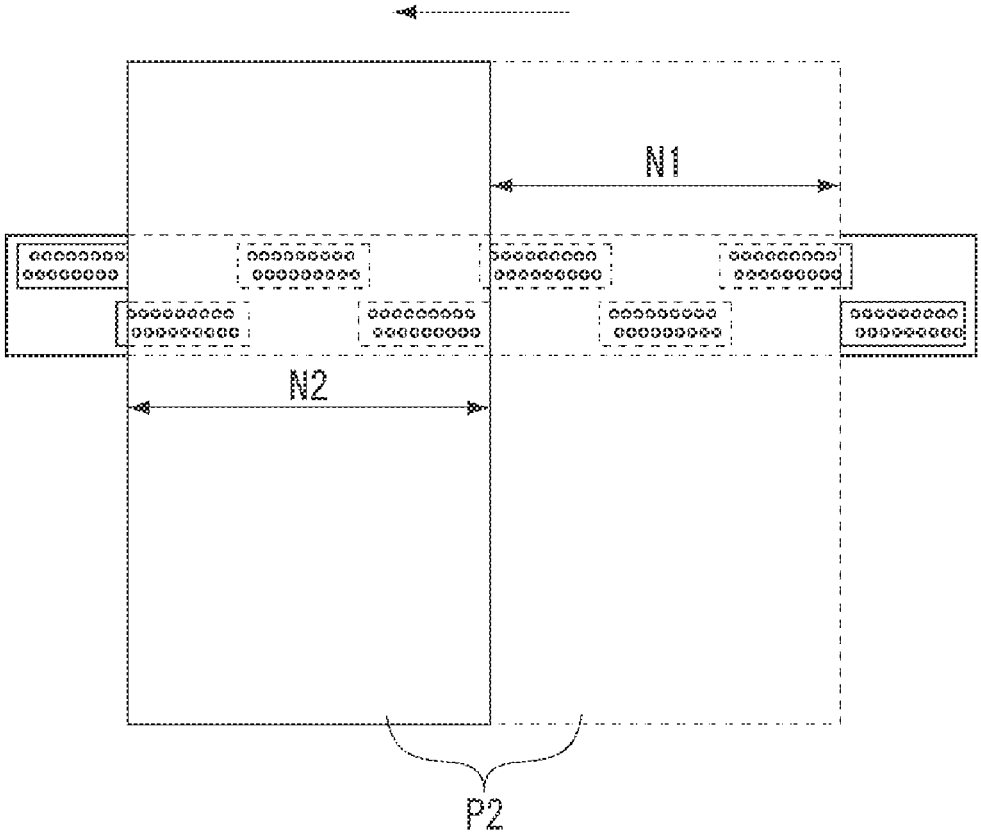
FIG. 9 illustrates switching of nozzle regions to be used for recording according to an exemplary embodiment.

The present exemplary embodiment solves this problem by an operation sequence as follows. Basically, the usage history information is stored and updated in the history memory 5 for each region, which is defined by grouping the recording elements of each recording head into a plurality of regions, or for each element. Then, the shift mechanism 27 is operated based on width information of a sheet to be used, and data stored in the history memory 5, and the sheet position in the width direction is shifted to the left or the right. More specifically, the sheet position is shifted from the standard state, illustrated in FIG. 3, to the left or the right by a distance Y2, as illustrated in FIGS. 6A and 6B. Then, recording elements to be used are set according to the width information of the sheet to be used and the shifted sheet position. For example, as illustrated in FIG. 9, a nozzle group region to be used is switched from a region N1 to a region N2 according to a shift of the sheet P2. The sheet P2 is shifted nozzle chip by nozzle chip. In the example illustrated in FIG. 9, three nozzle chips cover the region N1, and other three nozzle chips cover the region N2.

Figure 10B:
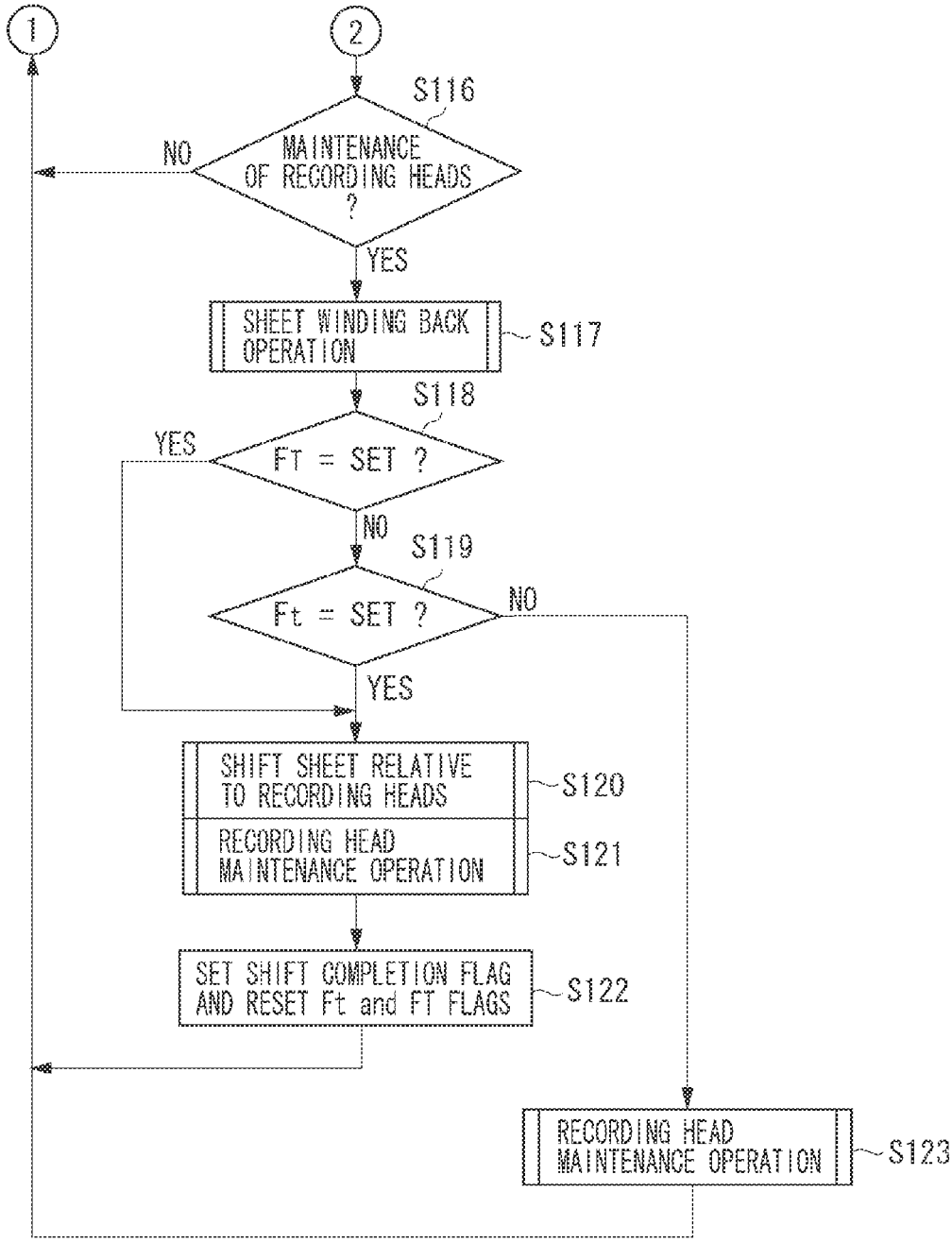

FIGS. 10A and 10B are flowcharts illustrating an operation sequence for image recording in the case of use of a sheet (for example, the sheet P2) having a narrower sheet width than that of the sheet P1. These sequences are controlled by the control unit 30. The default holding position of the sheet P2 is substantially the center in the sheet width direction as illustrated in FIG. 3. In an initial state, the control unit 30 causes the shift mechanism 27 to shift the sheet holding unit 26 so that the sheet P2 is located at the position illustrated in FIG. 3. Then, the control unit 30 waits for a recording instruction.

In step S101, the control unit 30 starts the sequence upon receiving a recording instruction. In step 102, it is determined whether the conveyance position of the sheet P2 should be changed. More specifically, the control unit 30 checks a shift completion flag indicating that the sheet position relative to the recording heads has been already shifted. If the flag is "SET" (a shift is completed) (YES in step S102), the processing proceeds to step S108. If the flag is not "SET" (NO in step S102), the processing proceeds to step 103.

The history memory 5 of each recording head stores two kinds of usage history information, i.e., a cumulative value of a use count for each nozzle region of the corresponding recording head, and a cumulative value of a conveyance distance for each shift position of the sheet P2. If the former usage history information exceeds a predetermined threshold value, a flag FT is set, and if the latter usage history information exceeds a predetermined threshold value, a flag Ft is set. In step S103, the control unit 30 checks whether the flag FT is in a "SET" state. If the flag FT is "SET" (YES in step S103), the processing proceeds to step S105. If the flag FT is not "SET" (NO in step S103), the processing proceeds to step S104. In step S104, the control unit 30 checks whether the flag Ft is in a "SET" state. If the flag Ft is "SET" (YES in step S104), the processing proceeds to step S105. If the flag Ft is not "SET" (NO in step S104), the processing proceeds to step S108.

Figure 7:
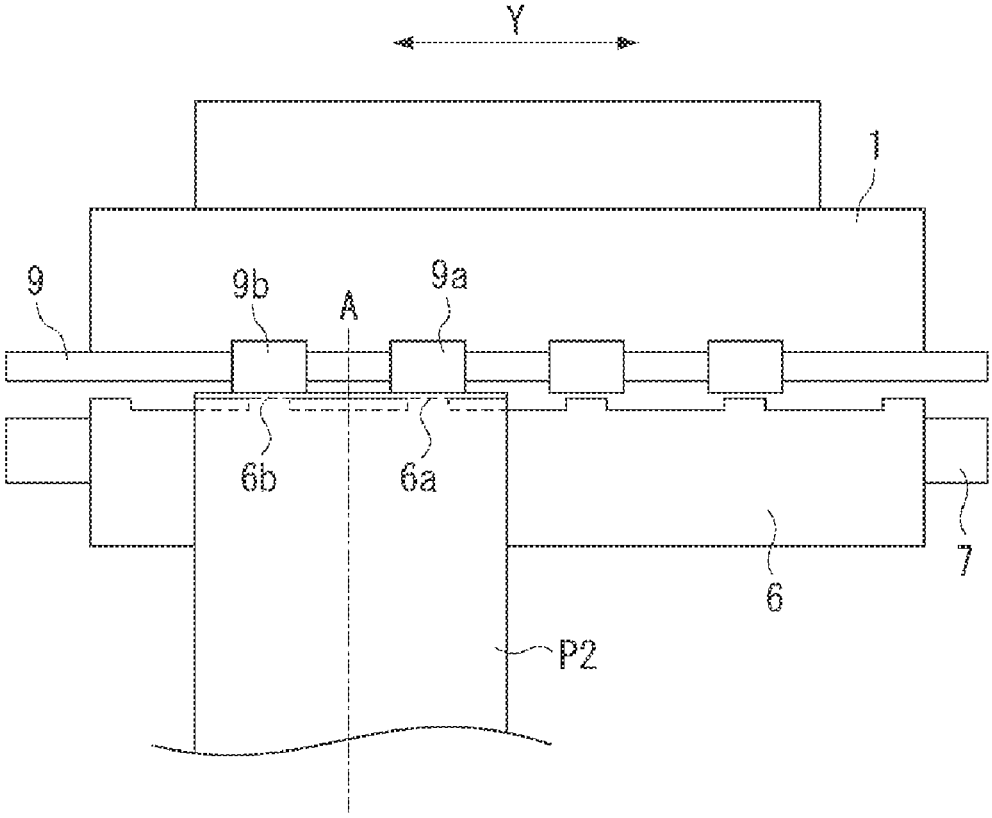
FIG. 7 illustrates a positional relationship between a sheet and parts of a conveyance system after a shift according to an exemplary embodiment.

In this way, if it is determined in step S103 or S104 that any of the flags (Ft and FT) is "SET", the processing proceeds to step S105. In step S105, the sheet P2 held by the sheet holding unit 26 is wound back by the drive force of a conveyance motor 104 to change the conveyance position of the sheet P2 relative to the width direction of the recording heads 1 to 4. In step S106, it is determined how much and in which direction the sheet P2 should be shifted according to the width information of the sheet P2 to be used and the two kinds of usage history information stored in the history memory 5. Then, the sheet P2 is shifted relative to the recording heads 1 to 4 by the drive force of the drive motor 14 of the sheet holding unit 26. FIG. 6A illustrates the sheet P2 shifted from the normal position to the left as viewed in FIG. 6A by the distance Y2. FIG. 6B illustrates the sheet P2 shifted from the normal position to the right as viewed in FIG. 6B by the distance Y2. As illustrated in FIG. 7, the position of the shifted sheet P2 is such a position that rollers 9*a* and 9*b*, and guide units 6*a* and 6*b* constituting the conveyance system are located line-symmetrically about the center line of the sheet P2. In step S107, the shift completion flag is set, and the flags (Ft and FT) are reset. Then, the processing returns to step S102.

In step S108, the sheet P2 is conveyed to the image recording unit 29 by the sheet conveyance mechanism 28. In step S109, a recording operation is performed onto the sheet at the image recording unit 29.

Figure 11:
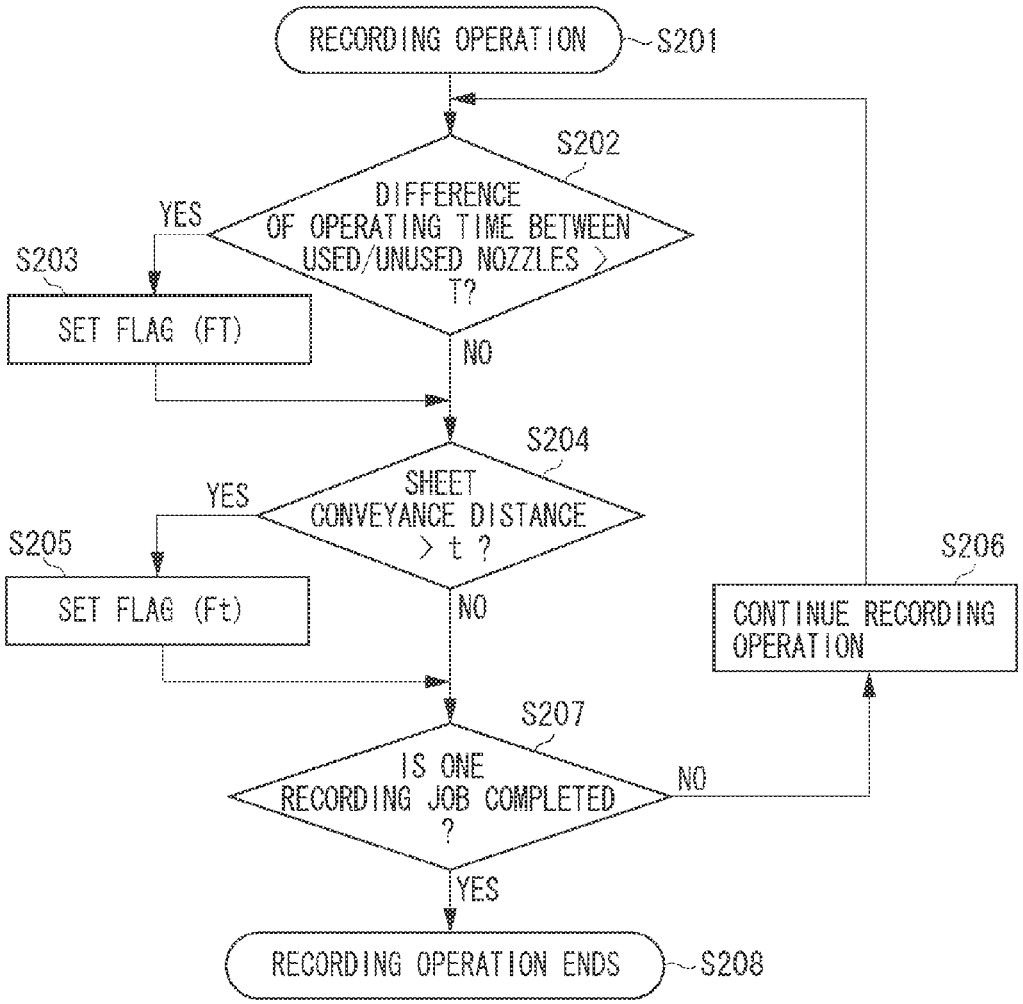
FIG. 11 is a flowchart illustrating a recording operation sequence according to an exemplary embodiment.

FIG. 11 is a flowchart illustrating a recording operation sequence performed in step S109. During a recording operation onto the sheet P2 at the image recording unit 29, the usage history information of each history memory 5 is updated. In particular, in step S202, it is determined whether the usage frequency of the used nozzle region of the recording head used in the stored recording operation exceeds a threshold value T. If the usage frequency exceeds the threshold value T (YES in step S202), the processing proceeds to step S203 where the flag FT is set. In step S204, it is determined whether the conveyance distance of the sheet P2 exceeds a threshold value t. If the conveyance distance exceeds the threshold value t (YES in step S204), the processing proceeds to step S205 where the flag Ft is set. Then, in step S207, it is determined whether the one recording job is completed. If the job is not completed (NO in step S207), the processing returns to step S206 where the recording operation is continued, and then further returns to step S202. If the one recording job is completed (YES in step S207), the processing proceeds to step S208 where the recording operation is ended. Then, the processing proceeds to the next step S110 in FIG. 10A.

Returning FIG. 10A, in step S110, it is determined whether there is a continuous recording job. If it is determined that all of jobs that should be performed are completed (NO in step S110), the processing proceeds to step S111. In step S111, the sheet P2 is wound back. In steps S112 and S113, it is confirmed whether the two flags (Ft and FT) for the usage history information are not set during the recording operation. If at least one of the flags is "SET", the processing proceeds to step S114. In step S114, how much and in which direction the sheet P2 should be shifted are determined according to the width information of the sheet P2 to be used and the two kinds of usage history information stored in the history memory 5. Then, the sheet P2 is shifted relative to the recording heads 1 to 4 by driving of the drive motor 14 of the sheet holding unit 26. In the subsequent step S115, the flags (Ft and FT) are reset, and the shift completion flag is set. Then, the processing proceeds to step S124 where the recording operation sequence is ended. On the other hand, if it is determined in steps 112 and 113 that neither of the flags is set during the recording operation, the processing proceeds to step S124 where the recording sequence is ended.

On the other hand, if it is determined in step S110 that there is left a job that should be performed (YES in step S110), the processing proceeds to step S116 in FIG. 10B. In step S116, the recording operation is continued, and concurrently, the control unit 30 waits for a request for maintenance of the recording heads 1 to 4. If there is no maintenance request (NO in step S116), the processing returns to step S109 in FIG. 10A. If there is a maintenance request (YES in step S116), the processing proceeds to step S117. In step S117, the sheet P2 is wound back. In steps S118 and S119, it is confirmed whether the two flags (Ft and FT) of the usage history information are not set during the recording operation. If at least one of them is "SET", the processing proceeds to step S120. In step S120, how much and in which direction the sheet P2 should be shifted are determined according to the two kinds of usage history information stored in the history memory 5. Then, the sheet P2 is shifted relative to the recording heads 1 to 4 by driving of the drive motor 14 of the sheet holding unit 26. Concurrently therewith, in step S121, a recording head maintenance operation is performed. In the subsequent step S122, the flags (Ft and FT) are reset, and the shift completion flag is set. Then, the processing returns to step S109 to resume the recording operation. On the other hand, if it is determined in steps S118 and S119 that neither of the two flags is set during the recording operation, the processing proceeds to step S123 to perform a recording head maintenance operation. Then, the processing returns to step S109 in FIG. 10A to resume the recording operation. In this way, the control unit 30 controls the shift mechanism to operate at the end of a recording job, at the start of a recording job, or at the time of head maintenance of the recording heads 1 to 4.

Figure 8B:
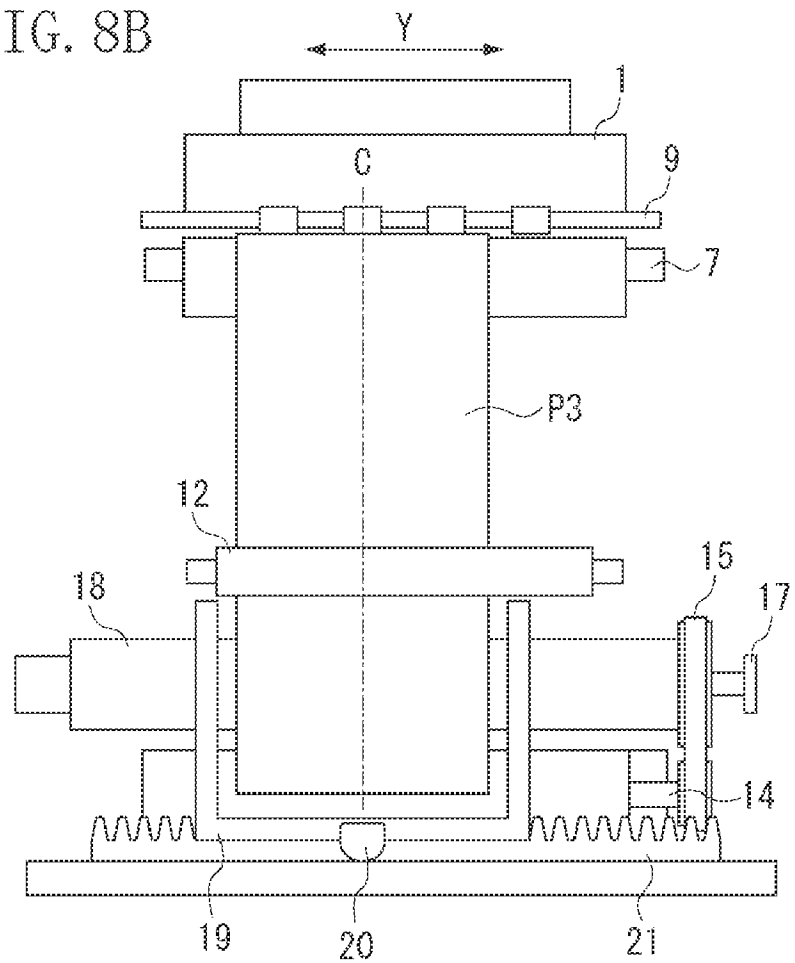
FIG. 8A and 8B are front views of the recording apparatus using a sheet of a middle width size according to an exemplary embodiment.
Figure 8A:
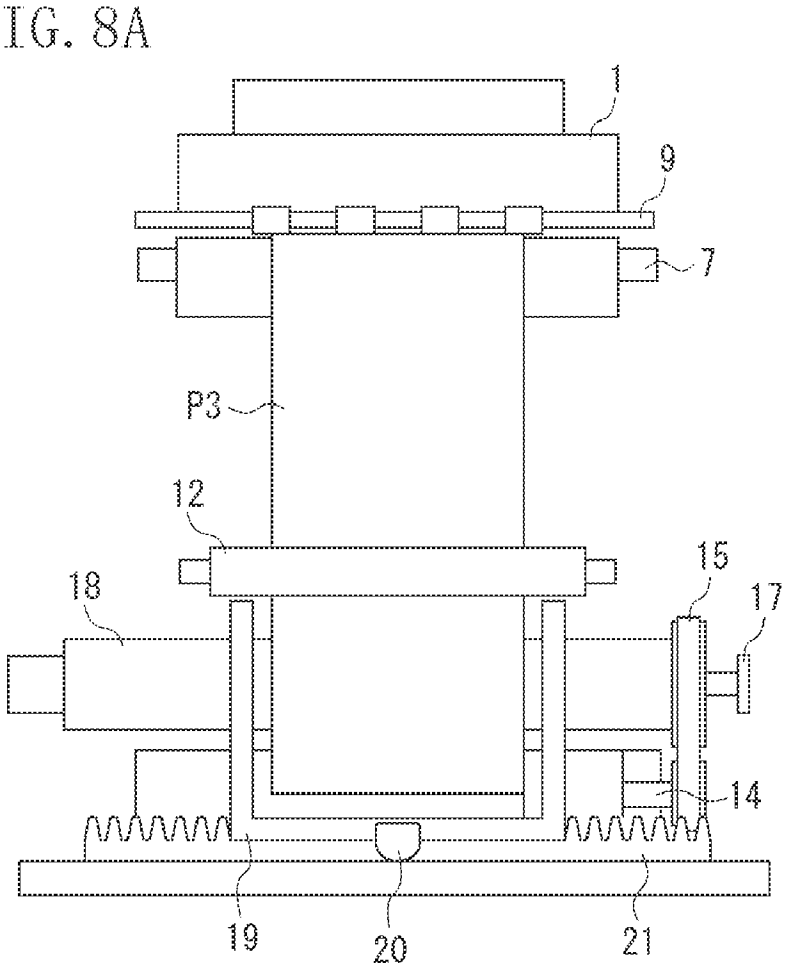

It should be noted that it is possible to use not only the sheet P1 having the maximum size and the sheet P2 having the minimum size but also a sheet having a width between the maximum size and the minimum size. FIGS. 8A and 8B illustrate use of a sheet P3 having a sheet width between the sheet P1 of the maximum size and the sheet P2 of the minimum size. Similarly to the recording on the sheet P2, the control unit 30 also controls the shift mechanism 27 to shift the sheet P3 based on the width information of the sheet P3 to be used and the usage history information. The present exemplary embodiment can handle two or more types of sheets having different sheet widths.

In this way, the present exemplary embodiment adjust a relative positional relationship between a sheet and the recording heads 1 to 4 based on the usage history information so that whole nozzle regions can be significantly evenly used and the sheet can significantly evenly pass over whole regions. As illustrated in FIG. 9, according to the shift of the sheet P2, the nozzle group to be used for the next recording is switched from the nozzle group N1 which was used before the shift to the nozzle group N2 located at a position shifted from the nozzle group N1 by the shift amount of the sheet P2. Due to this shift, it is possible to prevent the full-line type line recording heads 1 to 4 from being partially unevenly deteriorated, and prevent the parts constituting the sheet conveyance system, such as the rollers and the guides, from being unevenly abraded and deteriorated in the sheet width direction.

Further, the positional relationship between the shifted sheet P2 and the parts constituting the sheet conveyance system, such as the rollers and guides, is arranged so that the rollers and the guides are located on the opposite sides of the center line A of the sheet P2 in the sheet width direction symmetrically about the center line A. Referring to FIG. 7, the sheet P2 is shifted to such a position that the rollers 9*a* and 9*b* and the guide units 6*a* and 6*b* are located line-symmetrically about the center line A of the sheet P2. The control unit 30 controls the shift mechanism 27 to shift a sheet to such a position that two or more rollers as a part of the plurality of rollers dispersed in the width direction are located line-symmetrically with respect to the shifted sheet. Due to this arrangement, it is possible to eliminate unbalance of the conveyance resistance when a sheet is conveyed to realize stabilized sheet conveyance.

A second exemplary embodiment of the present invention will now be described. The present exemplary embodiment is characterized in that the shift mechanism can continuously shift the structure including the sheet holding unit 26 and apart of the conveyance mechanism in the sheet width direction relative to the recording heads.

Figure 12:
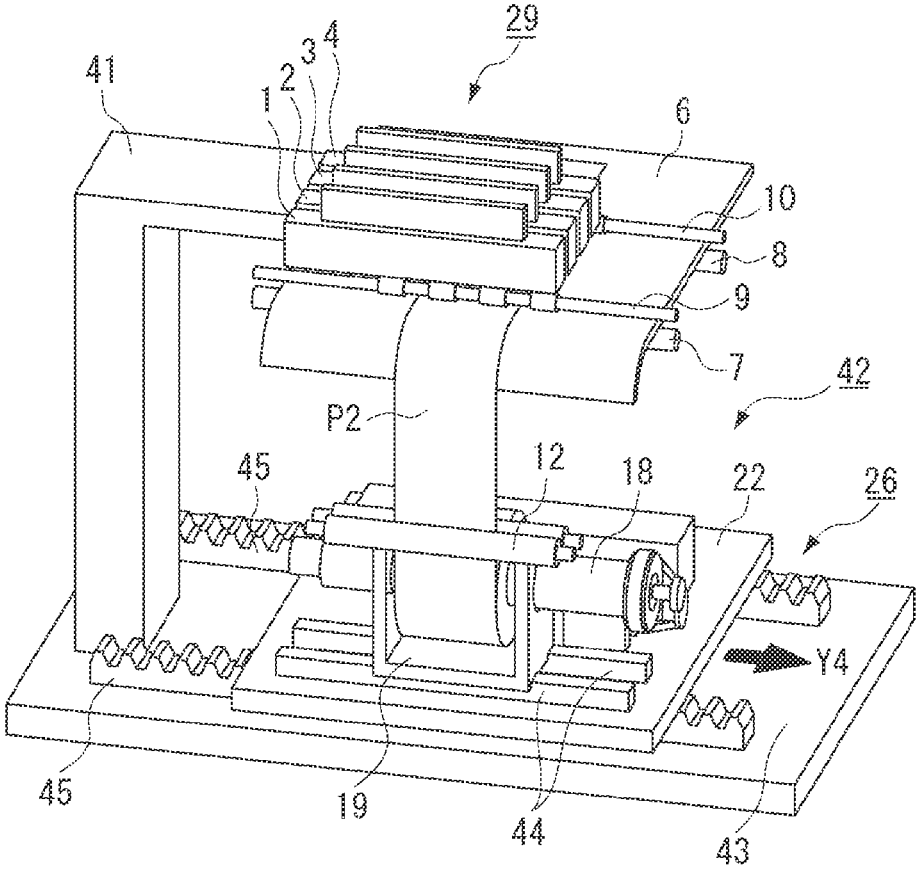
FIG. 12 is a perspective view illustrating a recording apparatus according to a second exemplary embodiment.

FIG. 12 is a perspective view of the recording apparatus according to the second exemplary embodiment. Like components will be denoted by like reference numerals as those in the above-discussed embodiment. A base 43 serves as a support base for all members. A support pole 41 fixed on the base 43 supports the image recording unit 29 including the recording heads 1 to 4. Further, guide rails 45 are disposed on the base 43, and the support board 22 is shiftably supported on the guide rails 45. A sheet holding unit configured in a similar manner to that illustrated in FIG. 1 is mounted on the support board 22. A difference of the sheet holding unit illustrated in FIG. 12 from that illustrated in FIG. 1 is that, in the sheet holding unit illustrated in FIG. 12, the holder 19 is fixed on the support board 22 by fixed supports 44.

A movable structure 42 is a structure formed by integrating the members of the sheet support unit placed on the support board 22, and the feeding rollers 12 which are a part of the sheet conveyance mechanism. The movable structure 42 is shifted in the sheet width direction along the guide rails 45 by the rack and pinion mechanism relative to the base 43 and the image recording unit 29 fixed by the support pole 41. The top surfaces of the guide rails 45 constitute rack gear surfaces, and pinion gears (not shown) are disposed under the bottom surface of the support board 22. The movable structure 42 can be shifted to an arbitrary position in a nonstop and continuous manner by a rotation of the drive source (not shown) for rotating the pinion gears. In sum, the shift mechanism according to the present exemplary embodiment shifts the structure including the sheet holding unit 26 and the feeding rollers 12 relative to the recording heads. The control unit sets nozzles to be used according to width information of a sheet to be used and a position of a shifted sheet, and records an image onto the sheet by the recording heads 1 to 4.

The other operation sequences of the present exemplary embodiment are the same as those of the above-mentioned first exemplary embodiment, and therefore the descriptions thereof will not be repeated for avoiding redundancy. The present exemplary embodiment can exert the same functions and bring about the same effects as those of the above-mentioned exemplary embodiment.

A third exemplary embodiment of the present invention will now be described. The present exemplary embodiment is characterized in that the shift mechanism can continuously shift a position of a sheet pulled out from the sheet holding unit in the sheet width direction relative to the recording heads and the sheet holding unit 26. More specifically, the conveyance mechanism includes loop generation rollers for generating a loop (slack) at a sheet in the middle of the feeding path, and the shift mechanism includes laterally movable rollers for holding a sheet and shifting the sheet in the sheet width direction at a position nearer to the recording position than the loop generation rollers are to the recording position.

Figure 13:
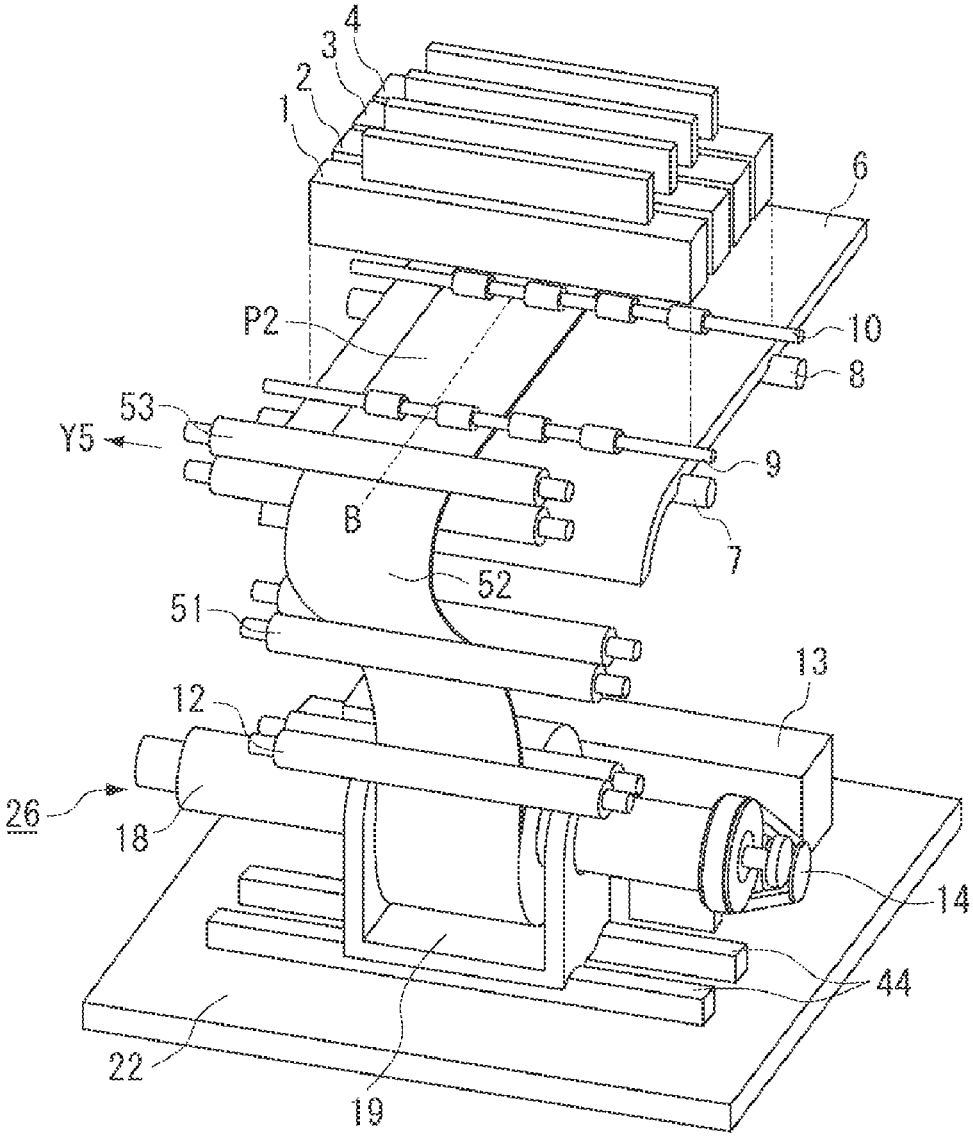
FIG. 13 is a perspective view illustrating a recording apparatus according to a third exemplary embodiment.
Figure 14:
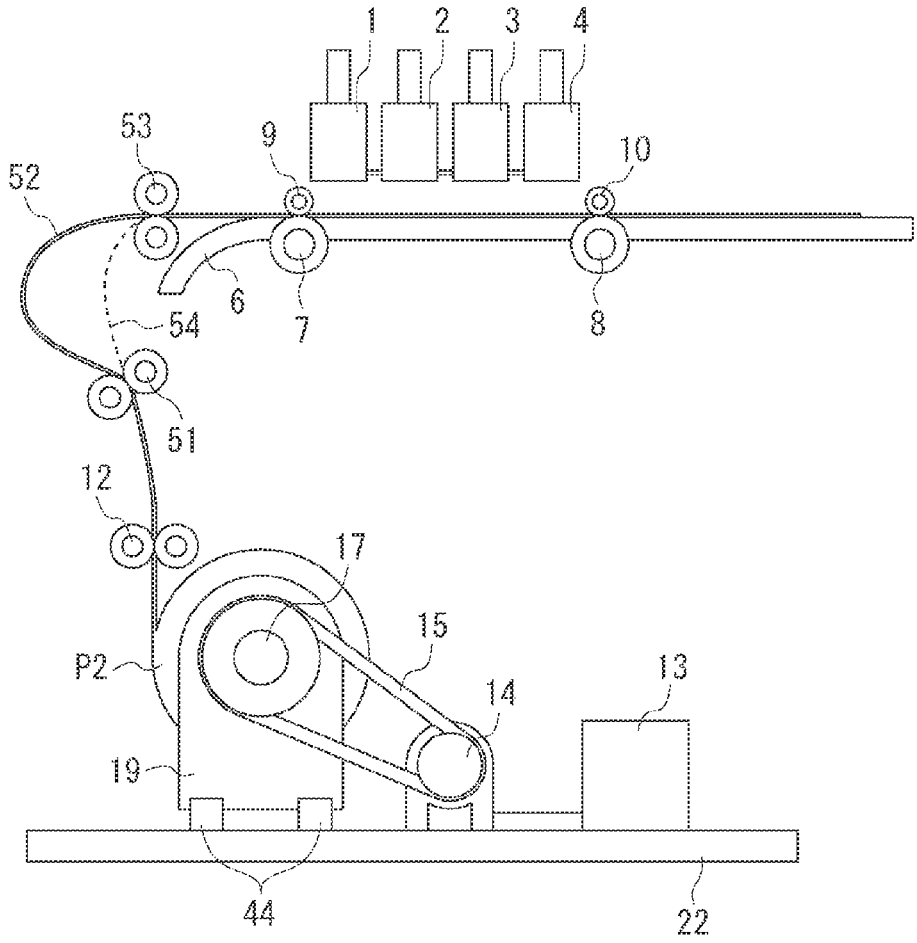
FIG. 14 is a cross-sectional view illustrating the recording apparatus according to the third exemplary embodiment.

FIGS. 13 and 14 are a perspective view and a cross-sectional view of the recording apparatus according to the third exemplary embodiment, respectively. Like components will be denoted by like reference numerals as those in the above-discussed embodiments. The sheet conveyance mechanism includes the feeding rollers 12, the main conveying roller 7, and the sub conveying roller 8 similar to those in the above-mentioned exemplary embodiments. Further, the loop generation rollers 51 (a first roller) and the laterally movable rollers 53 (a second roller) are disposed in this order between the feeding rollers 12 and the main conveying roller 7 on the conveyance path. The loop generation rollers 51 convey a sheet while holding it, and can generate a loop 52 of the sheet during conveyance by controlling the conveyance speed independently of the laterally movable rollers 53. The laterally movable rollers 53 can be shifted in the sheet width direction while holding a sheet, and is a part of the shift mechanism for shifting a currently conveyed sheet in the sheet width direction relative to the recording heads.

In a state that the sheet P2 is held by at least the loop generation rollers 51 and the laterally movable rollers 53, the sheet conveyance speed is increased compared to the speed at normal conveyance by increasing the rotational speed of the loop generation rollers 51. On the other hand, the speeds of the laterally movable rollers 53 and the rollers provided after the rollers 53 are not changed. As a result, a speed difference is generated between the loop generation rollers 51 and the laterally movable rollers 53, and the sheet slacks at a position between the loop generation rollers 51 and the laterally movable rollers 53 due to the generated speed difference. The slack of the sheet grows as time progresses, and thereby the loop 52 is generated. The path indicated by the dotted line 54 in FIG. 14 is the sheet path taken when a sheet is conveyed in a normal manner without a loop generated thereon. When the speed of the loop generation rollers 51 is changed, the speed of the feeding rollers 12 and the rotational speed of the support shaft by the drive motor 14 are also changed in synchronization therewith, so that a conveyance speed difference is not generated upstream of the loop generation rollers 51.

At predetermined timing when the loop 52 grows to have a sufficient slack amount as illustrated in FIG. 14, the sheet conveyance speed increased by the loop generation rollers 51 is returned to the normal conveyance speed. Then, the laterally movable rollers 53 are shifted in the direction indicated by the arrow Y5 in FIG. 13. Since the position of the sheet in the sheet width direction is offset between the loop generation rollers 51 and the laterally movable rollers 53, the sheet is twisted, but the loop 52 has a slack amount sufficient to absorb the twist. Therefore, the twist does not adversely affect the conveyance accuracy of the laterally movable rollers 53 and the sheet (for example, creation of a fold). The sheet is conveyed to a position determined by the laterally movable rollers 53 relative to the image recording unit. The control unit set nozzles to be used according to the width information of the sheet P2 to be used and the shifted sheet position, and records an image onto the sheet by the recording heads 1 to 4.

The size of the loop 52 can be freely set according to the rotational speed of the loop generation rollers 51 and the time period in which the increased speed is maintained. Therefore, preferably, the size of the loop is changed according to a distance by which the laterally movable rollers 53 are shifted. Since the twist of a sheet becomes larger as the sift distance is increased, a larger loop is generated according to an increase in the shift distance so that the generated twist can be absorbed. The control unit controls the loop generation by the loop generation rollers 51 so that the size of the loop 52 is changed according to a distance by which the laterally movable rollers 53 are shifted.

The other operation sequences of the present exemplary embodiment are the same as those of the above-mentioned first exemplary embodiment, and therefore the descriptions thereof will not be repeated for avoiding redundancy. The present exemplary embodiment can exert the same functions and bring about the same effects as those of the above-mentioned exemplary embodiment.

In the above-mentioned exemplary embodiments, the position of a sheet to be supplied is shifted relative to the positionally fixed recording heads. However, the present invention is not limited thereto. To the contrary, the shift mechanism may continuously shift the positions of the recording heads in the sheet width direction relative to the sheet holding unit and the conveyance mechanism. In other words, any member may be shifted, as long as it is possible for the shift mechanism to relatively shift the position of a sheet to be fed to the recording position in the sheet width direction with respect to the recording heads.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-265231 filed Nov. 20, 2009, which is hereby incorporated by reference herein in its entirety.

What is claimed is:

1. An apparatus comprising:

a line type recording head including a plurality of nozzle chips arranged along a width direction of a sheet, each of the nozzle chips having a plurality of recording elements;

a holding unit configured to hold a sheet;

a conveyance mechanism configured to convey the sheet held by the holding unit to a recording position of the recording head;

a shift mechanism capable of relatively changing a positional relation in the width direction between the recording head and the sheet fed from the holding unit at the recording position in order to change a region to be used for recording of the recording head; and a control unit configured to control the conveyance mechanism and the shift mechanism, wherein the control unit controls the shift mechanism to change the region on a nozzle-chip-by-nozzle-chip basis.

2. The apparatus according to claim 1, wherein the sheet comprises a continuous sheet, and the holding unit rotatably holds the continuous sheet wound into a roll.

3. The recording apparatus according to claim 1, further comprising a memory configured to store usage history information for each region which is defined by grouping the recording elements into a plurality of regions, or for each element, wherein the control unit controls the shift mechanism to shift the sheet position in the width direction based on width information of the sheet to be used and data stored in the memory, and performs a control so that the recording element to be used is set according to the width information of the sheet to be used and the shifted sheet position.

4. The apparatus according to claim 3, wherein the memory stores the usage history information for each of the nozzle chips.

5. The apparatus according to claim 1, wherein the control unit controls the shift mechanism to operate at an end of a recording job, at a start of a recording job, or at a time of head maintenance of the recording head.

6. The apparatus according to claim 1, wherein the shift mechanism shifts the fed sheet or the recording head in the width direction at a length corresponding to one or more of the nozzle chips to change the region.

7. The apparatus according to claim 1, wherein the control unit performs a control so that the sheet is wound back to the holding unit side before operating the shift mechanism.

8. The apparatus according to claim 1, wherein the shift mechanism can shift a position of the holding unit in the width direction relative to the recording head and the conveyance mechanism.

9. The apparatus according to claim 8, wherein, according to a plurality of sheets having different sheet widths, the shift mechanism fixes the holding unit at a position predetermined for each of them, and feeds the sheet by the conveyance mechanism.

10. The apparatus according to claim 1, wherein the shift mechanism can continuously shift a structure including the holding unit and a part of the conveyance mechanism in the width direction relative to the recording head.

11. The apparatus according to claim 1, wherein the shift mechanism can shift the position of the sheet pulled out from the holding unit in the width direction relative to the recording head and the holding unit.

12. The apparatus according to claim 11, wherein the conveyance mechanism includes a first roller for generating a loop of the sheet during feeding, and the shift mechanism includes a second roller for holding the sheet and shifting the sheet in the width direction at a position nearer to the recording position than the first roller is to the recording position.

13. The apparatus according to claim 12, wherein the control unit controls loop generation by the first roller so that a size of the loop is changed according to a distance by which the second roller is shifted.

14. The apparatus according to claim 1, wherein the shift mechanism can shift the position of the recording head in the width direction relative to the holding unit and the conveyance mechanism.

15. The apparatus according to claim 1, wherein the conveyance mechanism includes a plurality of rollers disposed to be dispersed in the width direction, and the control unit controls the shift mechanism to shift the sheet to such a position that a plurality of rollers as a part of the dispersed rollers is line-symmetrical with respect to the shifted sheet.

16. The apparatus according to claim 1, wherein the recording head records an image onto the sheet by discharging ink to the sheet.

17. An apparatus comprising:

a line type recording head including a plurality of nozzle chips arranged along a width direction of a sheet, each of the nozzle chips having a plurality of recording elements;

a feed unit configured to feed a sheet to a recording position of the recording head; and a mechanism capable of relatively changing a positional relation in the width direction between the recording head and the fed sheet in order to change a region to be used for recoding of the recording head, wherein the mechanism changes the region in units of nozzle chip.

18. The apparatus according to claim 17, wherein the mechanism shifts the fed sheet or the recording head in the width direction at a length corresponding to one or more of the nozzle chips to change the region.

19. The apparatus according to claim 18, wherein the sheet is a rolled continuous sheet.

20. An apparatus comprising:

a line type recording head including a plurality of sub-units of the recording head arranged along a width direction of a sheet, each of the sub-units having a plurality of recording elements;

a feed unit configured to feed a sheet to a recording position of the recording head; and a mechanism capable of changing a positional relation in the width direction between the recording head and the fed sheet in order to change a region to be used for recoding of the recording head, wherein the mechanism shifts the fed sheet or the recording head in the width direction at a length corresponding to one or more of the sub-units to change the region.

21. The apparatus according to claim 20, wherein the sheet is a rolled continuous sheet.

* * * * *